US009845547B2

(12) United States Patent
Kim et al.

(10) Patent No.: US 9,845,547 B2
(45) Date of Patent: Dec. 19, 2017

(54) ELECTROLYTIC SOLUTION AND METHOD FOR SURFACE TREATMENT OF ALUMINUM ALLOYS FOR CASTING

(71) Applicants: Hyundai Motor Company, Seoul (KR); Inha-Industry Partnership Institute, Incheon (KR)

(72) Inventors: Ye Lim Kim, Anyang-si (KR); Hyung Sop Yoon, Yongin-si (KR); Hyeon Seok Yoo, Incheon (KR); Dong Eun Lee, Bucheon-si (KR); Chul Ho Lee, Incheon (KR); Jin Sub Choi, Incheon (KR)

(73) Assignees: HYUNDAI MOTOR COMPANY, Seoul (KR); INHA-INDUSTRY PARTNERSHIP INSTITUTE, Incheon (KR)

( * ) Notice: Subject to any disclaimer, the term of this patent is extended or adjusted under 35 U.S.C. 154(b) by 185 days.

(21) Appl. No.: 14/621,008

(22) Filed: Feb. 12, 2015

(65) Prior Publication Data

US 2016/0115614 A1 Apr. 28, 2016

(30) Foreign Application Priority Data

Oct. 24, 2014 (KR) ..... 10-2014-0145141

(51) Int. Cl.
*C25D 11/06* (2006.01)
*C25D 11/10* (2006.01)
*C25D 11/08* (2006.01)

(52) U.S. Cl.
CPC ..... *C25D 11/10* (2013.01); *C25D 11/06* (2013.01); *C25D 11/08* (2013.01)

(58) Field of Classification Search
CPC ..... C25D 11/06; C25D 11/08; C25D 11/10
See application file for complete search history.

(56) References Cited

U.S. PATENT DOCUMENTS 4,833,065 A * 5/1989 Nakanishi ..... B41N 3/034 205/107
4,853,093 A * 8/1989 Brenk ..... B41N 3/034 205/214

(Continued)

FOREIGN PATENT DOCUMENTS

JP 08-260197 A 10/1996
JP H11-43798 A 2/1999

(Continued)

OTHER PUBLICATIONS

"Casting of 2024-Al Alloy Reinforced with Al2O3 Particles" by Abdel-Azim et al., J. Mater. Process. Technol. 55, pp. 199-205 (1995).*

(Continued)

*Primary Examiner* — Bryan D. Ripa
(74) *Attorney, Agent, or Firm* — McDermott Will & Emery LLP

(57) ABSTRACT

A method for surface treatment of aluminum alloys for forms an oxidation film in the aluminum alloys for casting by adding a metallic anion compound to an electrolytic solution. The method can prevent cracks from occurring on a surface of the aluminum alloys for casting at the time of applying an anodizing method.

4 Claims, 10 Drawing Sheets

(56) References Cited

U.S. PATENT DOCUMENTS

| | | | | |
|---|---|---|---|---|
| 6,335,099 | B1 * | 1/2002 | Higuchi | C25D 11/30 205/316 |
| 2010/0181229 | A1 * | 7/2010 | Hayasaka | B01J 29/064 208/28 |
| 2016/0319452 | A1 * | 11/2016 | Eidschun | C23C 18/1689 |

FOREIGN PATENT DOCUMENTS

| | | | |
|---|---|---|---|
| JP | 11-209893 | A | 8/1999 |
| JP | 5017876 | B2 | 9/2012 |
| KR | 10-2003-0024570 | A | 3/2003 |
| KR | 10-0696000 | B1 | 3/2007 |
| KR | 10-1285485 | B1 | 7/2013 |

OTHER PUBLICATIONS

Korean Office Action dated Jan. 4, 2016 issued in Korean Patent Application No. 10-2014-0145141.

J. K. Park, "Anticorrosion and Metal Finishing," Sejin Publishers Inc., Sep. 21, 1976, Seoul, Republic of Korea, p. 457 (English translation).

* cited by examiner

-Prior Art-

ELECTROLYTIC SOLUTION AND METHOD FOR SURFACE TREATMENT OF ALUMINUM ALLOYS FOR CASTING

CROSS-REFERENCE(S) TO RELATED APPLICATIONS

This application claims the benefit of priority to Korean Patent Application No. 10-2014-0145141, filed in the Korean Intellectual Property Office on Oct. 24, 2014, which is incorporated herein by reference in its entirety.

TECHNICAL FIELD

The present disclosure relate to an electrolytic solution and a method for surface treatment of aluminum alloys for casting, and more particularly, to an electrolytic solution and a method for surface treatment of aluminum alloys for casting capable of preventing cracks from occurring on a surface of aluminum alloys for casting at the time of applying an anodizing method.

BACKGROUND

Aluminum alloys have more reduced corrosion resistance than that of pure aluminum due to their alloy elements. Therefore, an oxidation film needs to be electrochemically formed on a surface of the aluminum alloys to enhance surface wear resistance. Herein, a method for forming the oxidation film is referred to as an anodizing method.

The anodizing method is a compound word of anode and oxidizing and is a method for forming an aluminum film ($Al_2O_3$) by conducting electricity in an electrolytic solution using an aluminum alloy as an anode and oxidizing an aluminum surface by oxygen generated from the anode.

The aluminum film has excellent durability and corrosion resistance, and a micro columnar cell thereof ranges from several nm to several μm growing thereon to form a micro porous surface.

General anodization is performed using an electrolyte in which a concentration of sulfuric acid ranges from 15 to 20 wt %.

Referring to FIG. 1, aluminum alloys for casting include a large amount of Si for improvement of fluidity. In the alloys including the large amount of Si, the Si is not dissolved during an anodizing process, and therefore remains in place and lumps of non-anodized Si form an island to cause cracks on a surface of an oxidation film, thereby reducing corrosion resistance.

The contents described as the related art have been provided only for assisting in the understanding for the background of the present disclosure and should not be considered as corresponding to the related art known to those skilled in the art.

SUMMARY

An aspect of the present inventive concept is directed to providing an electrolytic solution and a method for surface treatment of aluminum alloys for casting capable of preventing corrosion resistance from reducing due to cracks occurring on a surface of an oxidation film which is caused by an island formed due to lumps of Si which are not anodized in an alloy including a large amount of Si.

Other objects and advantages of the present disclosure can be understood by the following description, and become apparent with reference to the embodiments of the present inventive concept. Also, it is obvious to those skilled in the art to which the present disclosure pertains that the objects and advantages of the present invention can be realized by the means as claimed and combinations thereof.

In accordance with an embodiment of the present inventive concept, a method for surface treatment of aluminum alloys for casting includes forming an oxidation film in the aluminum alloys for casting by adding a metallic anion compound to an electrolytic solution.

The electrolytic solution may be prepared using any one material selected from sulfuric acid and oxalic acid as a base.

The metallic anion compound may be $NaAlO_2$.

The metallic anion compound may be any one selected from $NaMoO_4$ and $Na_2Ti_3O_7$.

The aluminum alloy for casting may include Si ranging from 4.0 to 24.0 wt %, and the oxidation film may have a thickness which is set to be equal to or more than 5 μm.

The method may further include preparing an electrolytic solution by selecting any one of sulfuric acid and oxalic acid. Any one metallic anion compound which is selected from the group consisting of $NaMoO_4$, $Na_2Ti_3O_7$, and $NaAlO_2$ is selected, and the selected metallic anion compound is added to the electrolytic solution. Anions of the metallic anion compound included in the electrolytic solution are coupled with cracks formed on a surface of the aluminum alloys for casting by controlling a range of voltage, current, time, and temperature.

The voltage may be controlled to be within a range of 10 to 200 V, the current may be controlled to be within a range of 0.2 to 10 A/cm$^2$, and the time may be controlled to be within a range of 1 to 24 h. The metallic anion compound may be added within a range of 0.02 to 0.4 M.

In accordance with another embodiment of the present inventive concept, an electrolytic solution for surface treatment of aluminum alloys for casting in provided, in which any one metallic anion compound selected from the group consisting of $NaMoO_4$, $Na_2Ti_3O_7$, and $NaAlO_2$ is added to any one selected from a sulfuric acid solution and an oxalic acid solution to form an oxidizing film on a surface of the aluminum alloys for casting including Si of 4.0 to 24.0 wt %.

DETAILED DESCRIPTION

Hereinafter, an electrolytic solution and a method for surface treatment of aluminum alloys for casting in accordance with exemplary embodiments of the present inventive concept will be described with reference to the accompanying drawings.

An electrolytic solution for surface treatment of aluminum alloys for casting in accordance with an exemplary embodiment of the present inventive concept is obtained by adding any one metallic anion compound selected from the group consisting of $NaMoO_4$, $Na_2Ti_3O_7$, and $NaAlO_2$ to any one selected from a sulfuric acid solution and an oxalic acid solution to form an oxidizing film on a surface of aluminum alloys for casting including Si of 4.0 to 24.0 wt %.

It is possible to prevent cracks from occurring at the time of anodizing the aluminum alloys for high Si casting by the surface treatment of the aluminum alloys for casting using the electrolytic solution, in which the Si ranges from 4.0 to 24.0 wt %.

The method for surface treatment of the aluminum alloys for casting in accordance with the exemplary embodiment of the present inventive concept includes preparing an electrolytic solution by selecting any one of sulfuric acid and oxalic acid. Any one metallic anion compound selected from the group consisting of $NaMoO_4$, $Na_2Ti_3O_7$, and $NaAlO_2$ is selected and the selected metallic anion compound is added to the electrolytic solution. Anions of the metallic anion compounds included in the electrolytic solution are coupled with the cracks formed on the surface of aluminum alloys for casting by controlling a range of voltage, current, time, and temperature.

Figure 1:
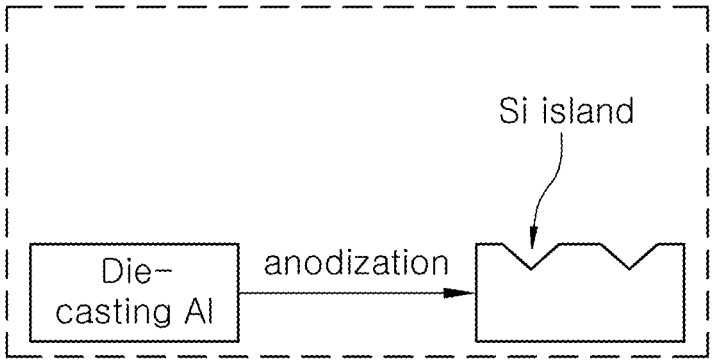
FIG. 1 is a diagram illustrating a process of forming cracks on a surface of an oxidation film by forming and island by lumps of Si during a conventional anodizing process.
Figure 2:
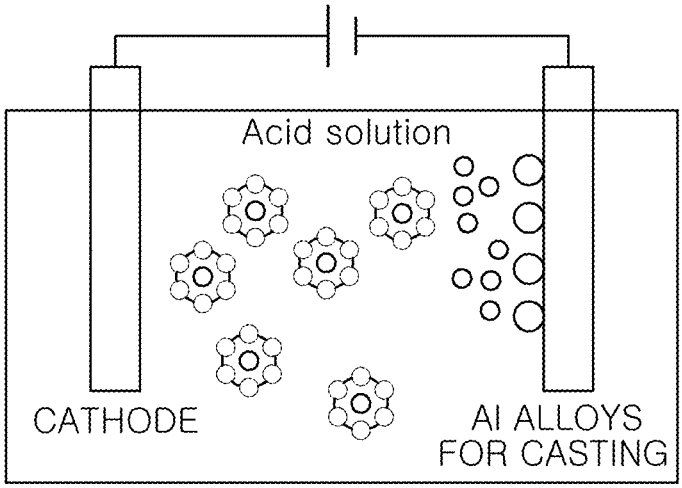
FIG. 2 is a diagram illustrating a surface treatment mechanism of aluminum alloys for casting in accordance with an exemplary embodiment of the present inventive concept.

As illustrated in FIG. 2, by applying an anodizing method using the electrolytic solution in which any one metallic anion compound selected from the group consisting of $NaMoO_4$, $Na_2Ti_3O_7$, and $NaAlO_2$ is added to any one of the sulfuric acid and the oxalic acid, $Al_2O^-$ in the metallic anion compound is dissociated within an electrolyte and is then coupled with cracks on the surface of the aluminum alloys for casting which occurs at the time of the anodizing.

An ion reaction of the $NaAlO_2$ of the metallic anion compound is represented as follows.

$$NaAlO_2 \text{------>} Na^+ + Al2O^-$$

Figure 3:
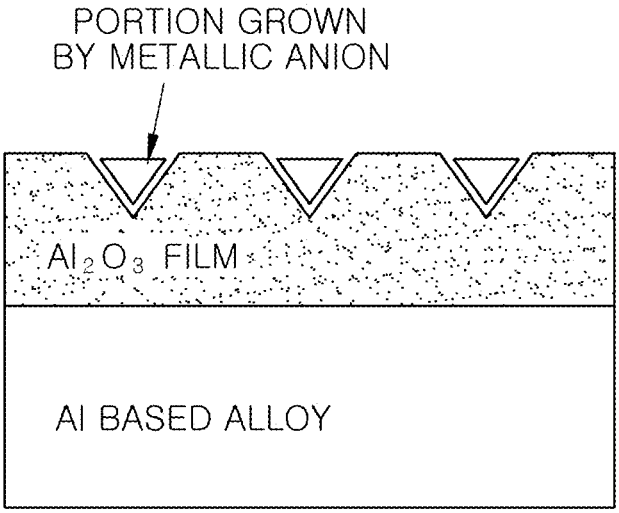
FIG. 3 is a diagram illustrating a crack prevention mechanism of aluminum alloys for casting to which a treatment method in accordance with an exemplary embodiment of the present inventive concept is applied.
Figure 4A:
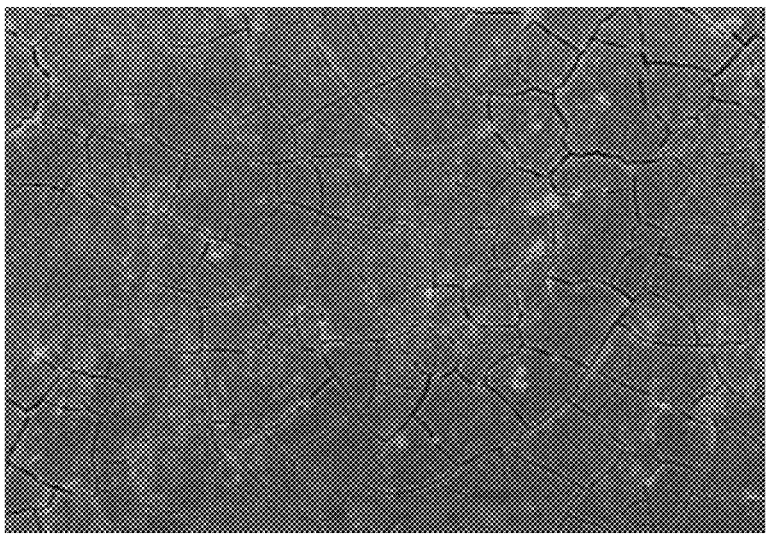
FIGS. 4A to 4D are photographs illustrating results obtained by observing a surface of aluminum alloy ingots ADC12 alloy anodized in (a) $H_2SO_4$ which is an electrolyte used in the conventional sulfuric method, (b) $H_2SO_4$+0.02M $NaAlO_2$, (c) $H_2SO_4$+0.1 M $NaAlO_2$, and (d) $H_2SO_4$+0.2M $NaAlO_2$ for 2 hours using an electron microscope.
Figure 4B:
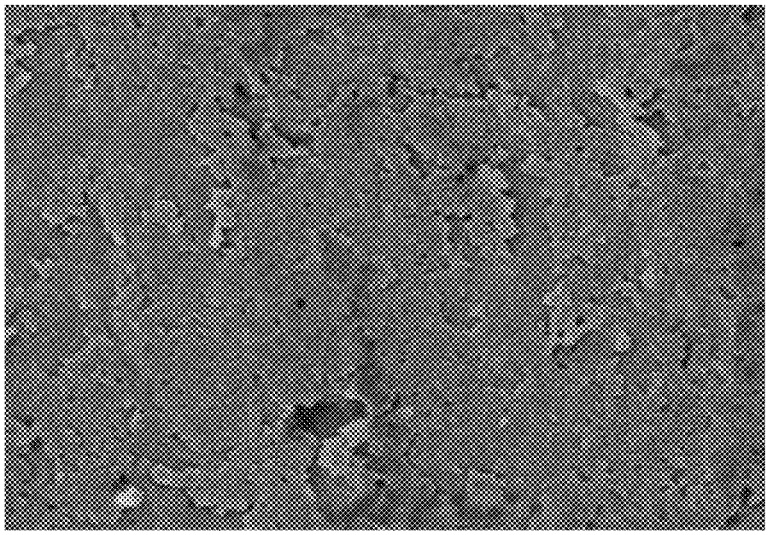
Figure 4C:
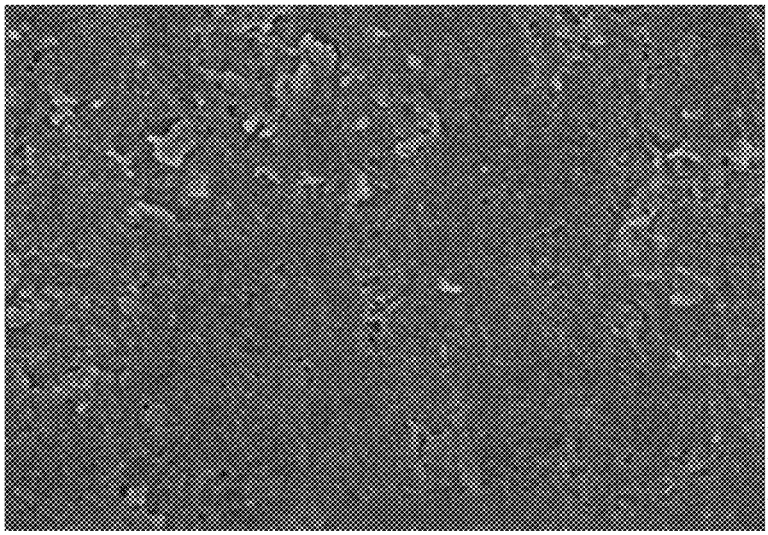
Figure 4D:
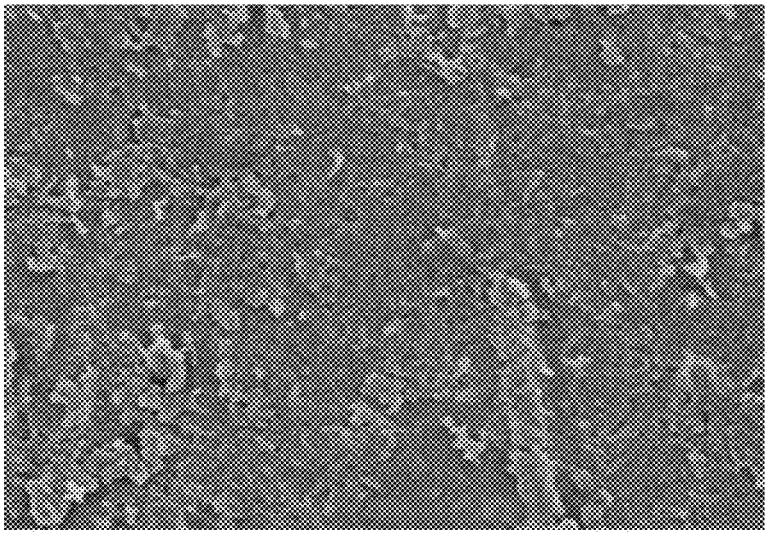
Figure 5A:
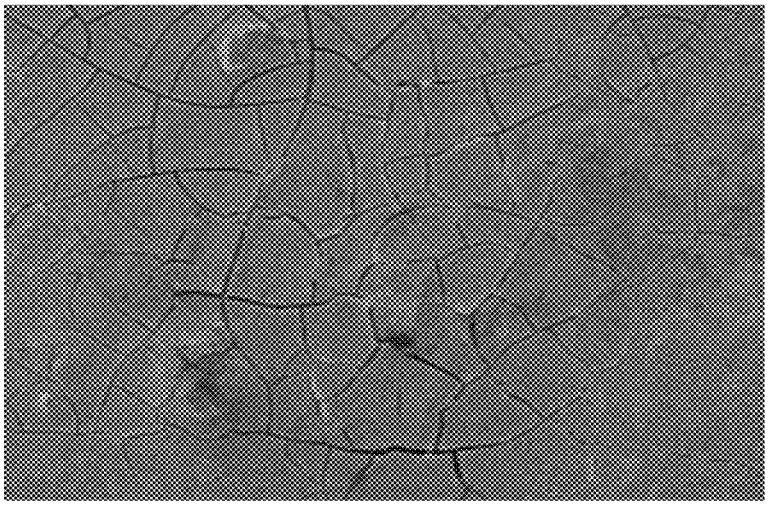
FIGS. 5A to 5D are photographs illustrating results obtained by observing a surface of ADC12 alloy anodized in (a) $H_2SO_4$ which is an electrolyte used in the conventional sulfuric method, (b) $H_2SO_4$+0.02M $NaAlO_2$, (c) $H_2SO_4$+0.1 M $NaAlO_2$, and (d) $H_2SO_4$+0.2M $NaAlO_2$ for 3 hours using an electron microscope.
Figure 5B:
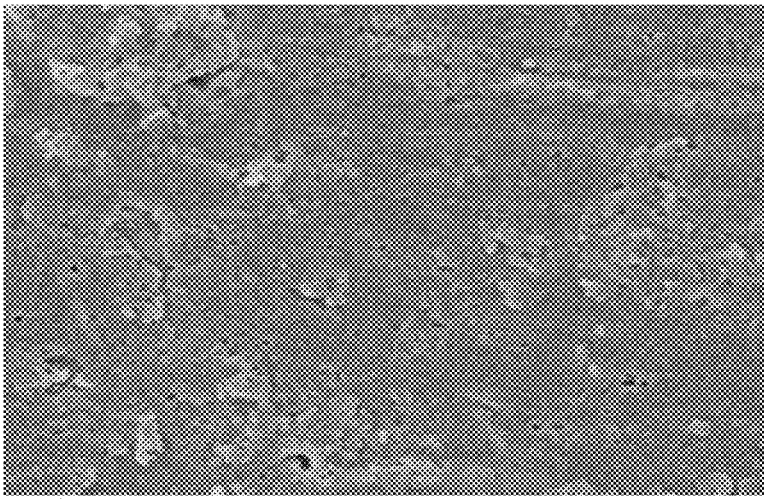
Figure 5C:
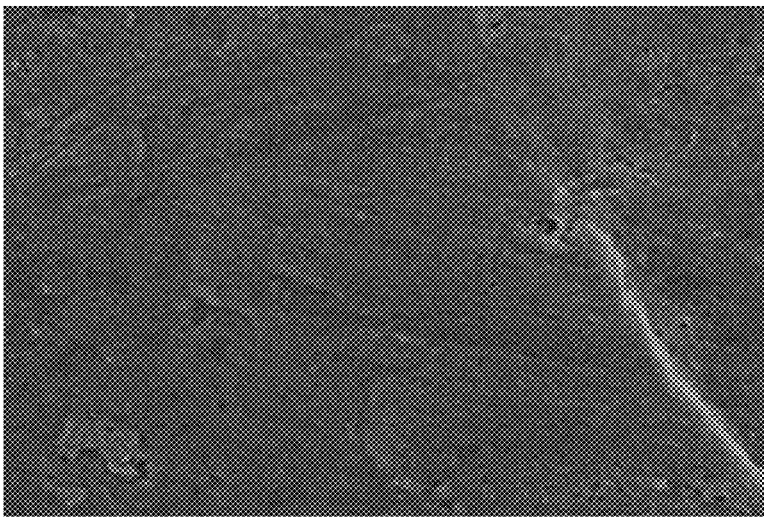
Figure 5D:
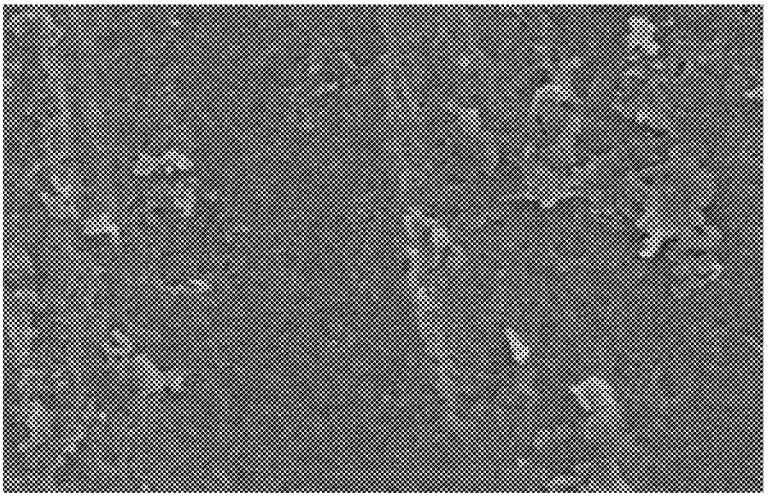
Figure 6A:
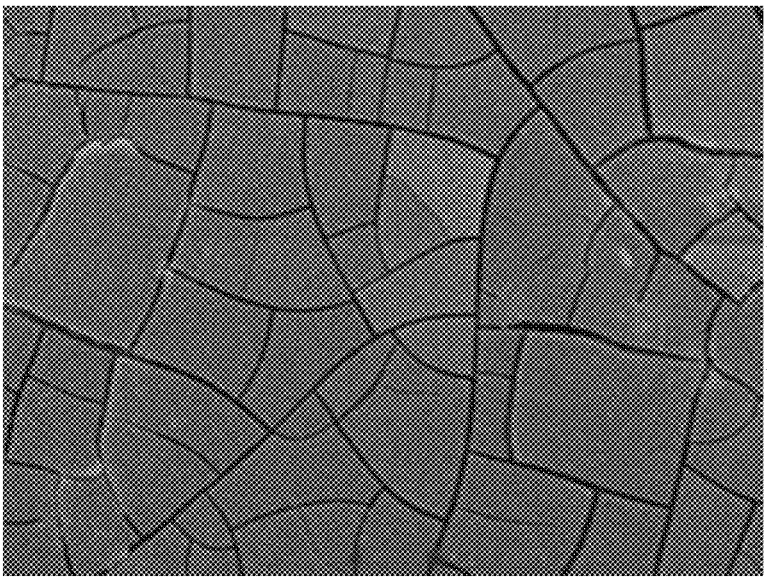
FIGS. 6A to 6D are photographs illustrating results obtained by observing a surface of ADC12 alloy anodized in (a) $H_2SO_4$ which is an electrolyte used in the conventional sulfuric method, (b) $H_2SO_4$+0.02M $NaAlO_2$, (c) $H_2SO_4$+0.1 M $NaAlO_2$, and (d) $H_2SO_4$+0.2M $NaAlO_2$ for 4 hours using an electron microscope.
Figure 6B:
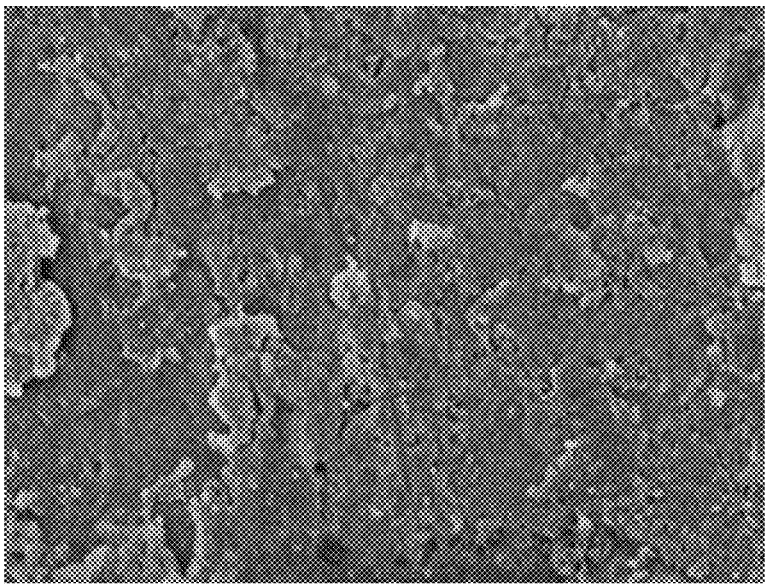
Figure 6C:
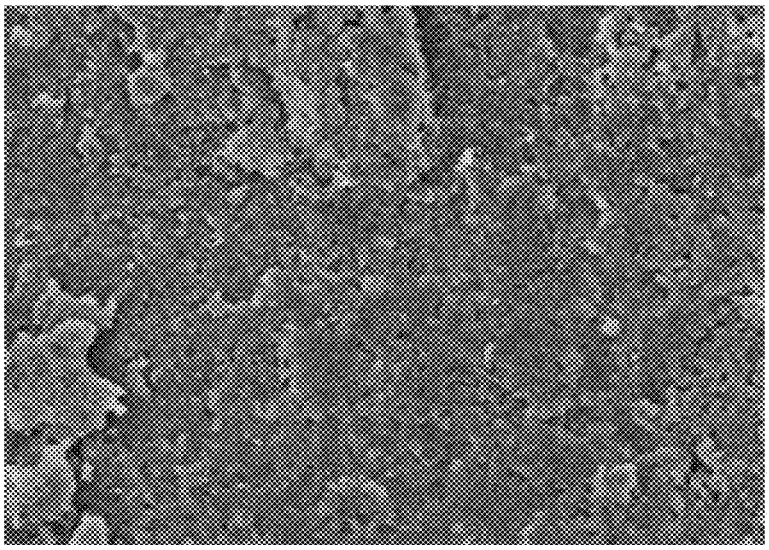
Figure 6D:
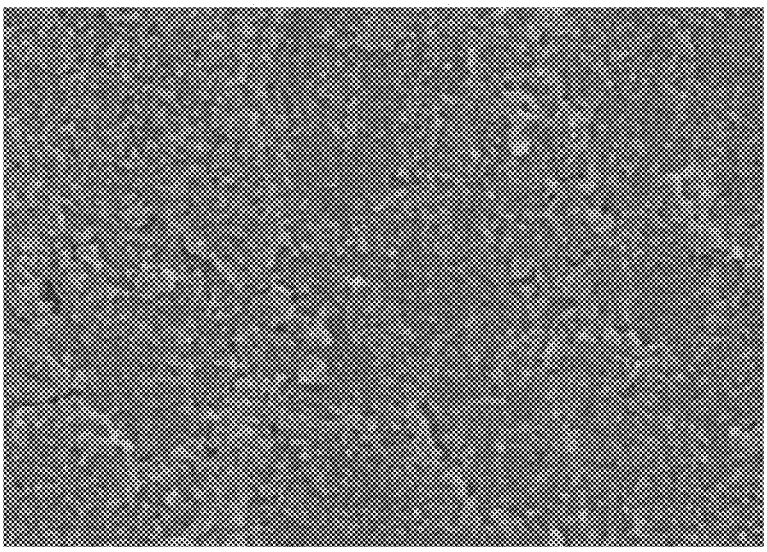

As illustrated in FIG. 3, the surface cracks occurring due to the Si are prevented by coupling the foregoing metal anions with the cracks on the $Al_2O_3$ oxidation film of the surface of aluminum alloys (Al based alloy) for casting and growing it.

The method for surface treatment of aluminum alloys for casting in accordance with the exemplary embodiment of the present inventive concept embodies a surface treatment process to prepare the optimal electrolytic solution at the time of applying the anodizing method and apply the electrolytic solution to the surface treatment method, which will be described below.

At the time of performing the surface treatment of aluminum alloys for casting, various conditions such as voltage, current, time, temperature, a kind of added metallic anion compounds, and the like need to be controlled. These conditions need to form a thick film of 5 μm in the aluminum alloys for casting including the high Si and be optimally maintained to enhance corrosion resistance, wear resistance, and film hardness by removing the cracks.

Each of the voltage and the current needs to be applied at 10 to 200 V and 0.2 to 10 A/cm$^2$, the surface treatment process needs to be performed within a range of 1 to 24 h, and the metallic anion compound needs to be added within a range of 0.02 to 0.4 M.

Lower limits of the voltage, current, and time ranges are minimum values of the voltage, current, and time for anionization in the electrolytic solution for the surface treatment of aluminum alloys for casting, and upper limits thereof are maximum values of the voltage, current, and time to prevent a load from being excessively applied at the time of anodizing.

The temperature of the electrolytic may range from 0 to 90° C., and as described above, the added metallic anion compound may be any one selected from the group consisting of $NaMoO_4$, $Na_2Ti_3O_7$, and $NaAlO_2$.

The amount of the metallic anion compound may not exceed 0.4 M since the metal anion compound needs to be added at an enough amount to be dissolved in the electrolytic solution.

FIGS. 4A to 4D are photographs illustrating results obtained by observing a surface of ADC12 alloy anodized in (a) $H_2SO_4$ which is an electrolyte used in the conventional sulfuric method, (b) $H_2SO_4$+0.02M $NaAlO_2$, (c) $H_2SO_4$+0.1 M $NaAlO_2$, and (d) $H_2SO_4$+0.2M $NaAlO_2$ for 2 hours using an electron microscope. FIGS. 5A to 5D are photographs illustrating results obtained by observing a surface of ADC12 alloy anodized in (a) $H_2SO_4$ which is an electrolyte used in the conventional sulfuric method, (b) $H_2SO_4$+0.02M $NaAlO_2$, (c) $H_2SO_4$+0.1 M $NaAlO_2$, and (d) $H_2SO_4$+0.2M $NaAlO_2$ for 3 hours using an electron microscope. FIGS. 6A to 6D are photographs illustrating results obtained by observing a surface of ADC12 alloy anodized in (a) $H_2SO_4$ which is an electrolyte used in the conventional sulfuric method, (b) $H_2SO_4$+0.02M $NaAlO_2$, (c) $H_2SO_4$+0.1 M $NaAlO_2$, and (d) $H_2SO_4$+0.2M $NaAlO_2$ for 4 hours using an electron microscope.

Figure 8:
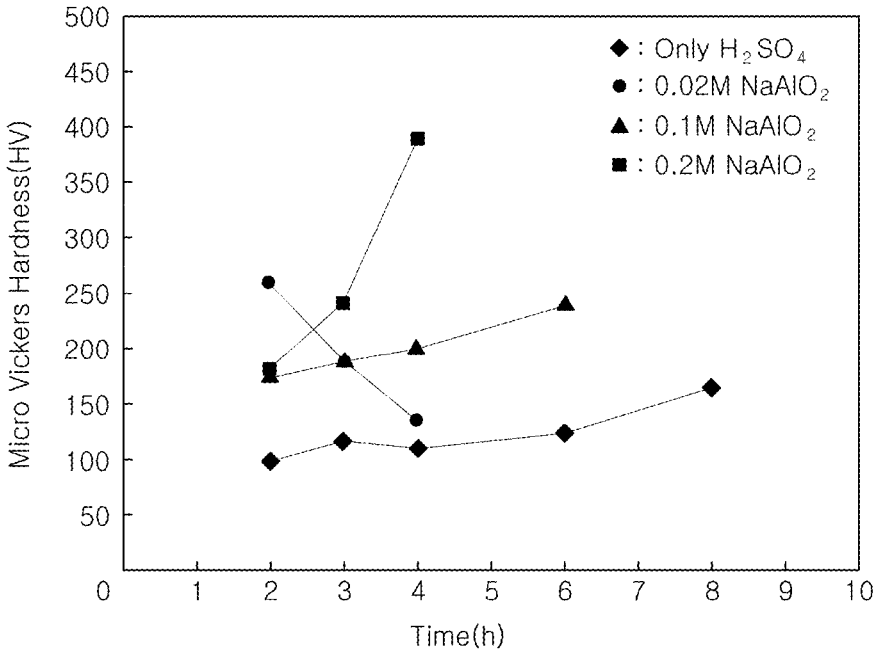
FIG. 8 is a graph illustrating a polarization curve of ADC12 which is anodized for (a) 2 hours, (b) 3 hours, and (c) 4 hours using $H_2SO_4$ and $H_2SO_4$+0.2M $NaAlO_2$.

It may be appreciated from FIG. 8 that except when the anodization is performed in a metal anion electrolyte to which 0.02M $NaAlO_2$ is added, anodizing film hardness of ADC12 alloy is increased when the anodizing is performed in the metal anion electrolyte to which 0.1M and 0.2M $NaAlO_2$ is added.

Figure 7A:
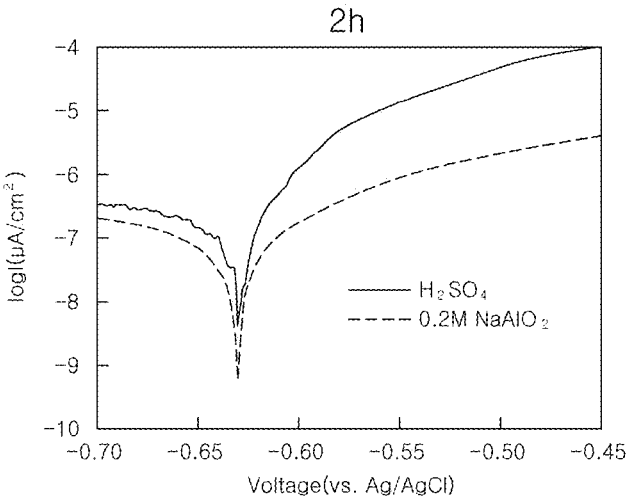
FIGS. 7A to 7C are diagrams illustrating anodizing film hardness of a surface of ADC12 alloy.
Figure 7B:
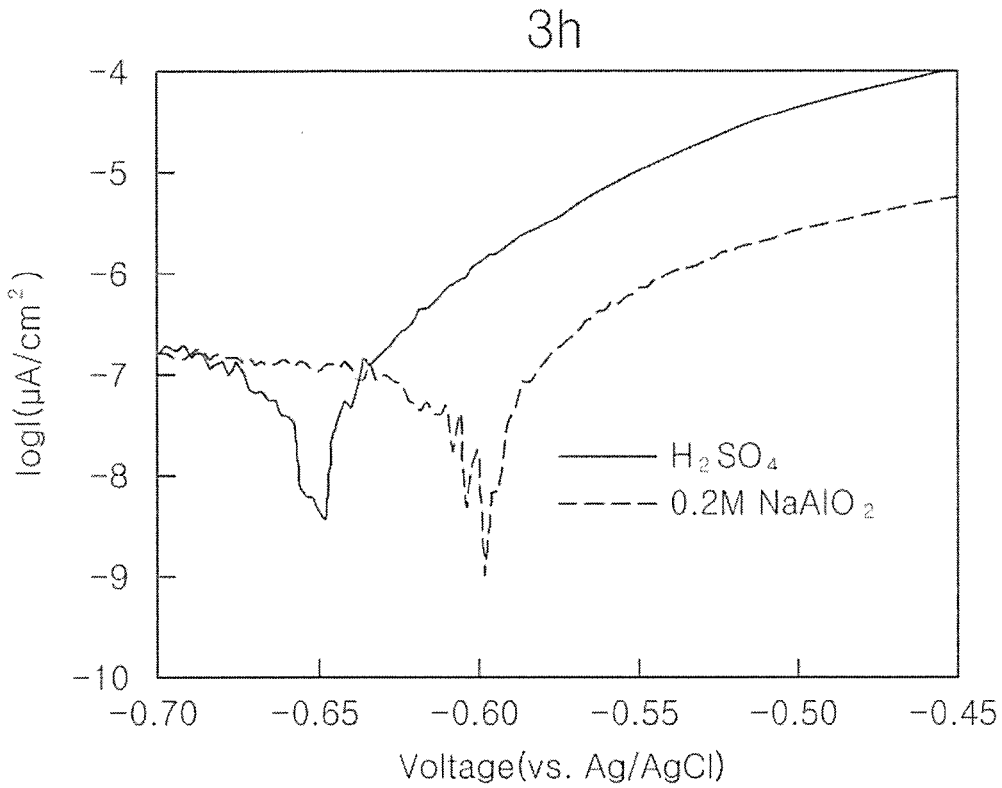
Figure 7C:
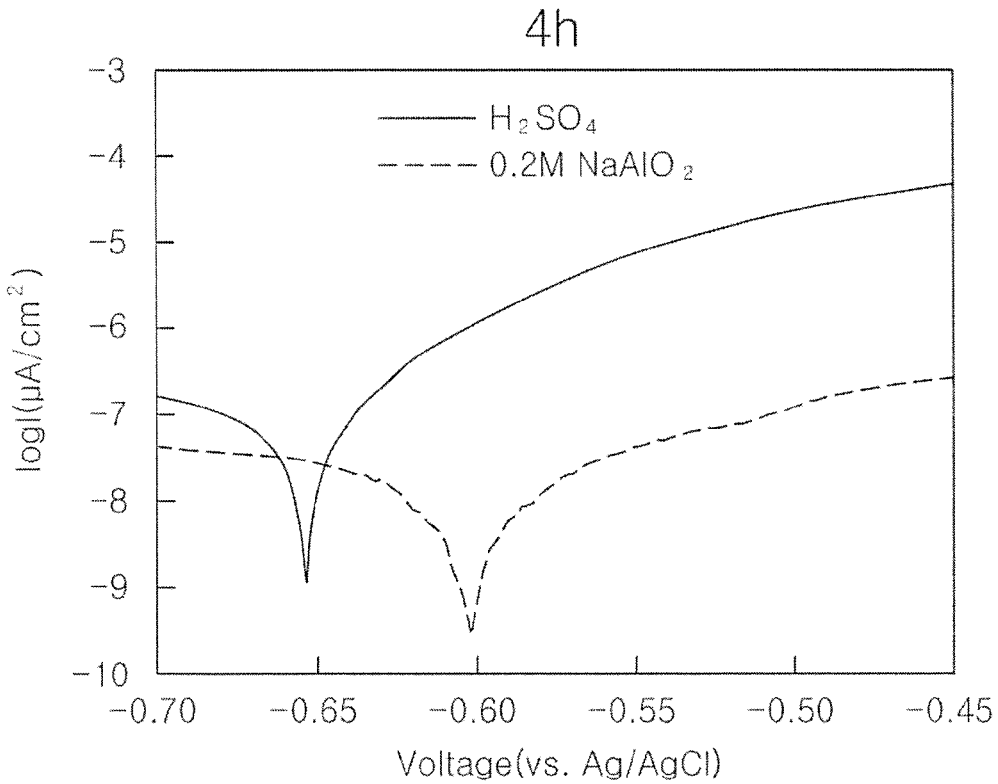

FIGS. 7A to 7C are a graph illustrating a polarization curve of ADC12 which is anodized for (a) 2 hours, (b) 3 hours, and (c) 4 hours using $H_2SO_4$ and $H_2SO_4$+0.2M $NaAlO_2$.

It may be appreciated that a Tafel plot of the ADC12 alloy anodized in the electrolyte to which the 0.2M $NaAlO_2$ is added moves to the right further than the ADC12 alloy anodized by using only the $H_2SO_4$ as the electrolyte, and as a result, it may be appreciated that corrosion resistance of the ADC12 alloy anodized in the electrolyte to which the 0.2M $NaAlO_2$ is added is enhanced.

In accordance with exemplary embodiments of the present inventive concept, various effects as follow may be obtained due to the above-mentioned technical configuration.

First, it is possible to form a thick film of 5 μm or more in the aluminum alloys for casting including high Si by using metallic anion compounds.

Second, it is possible to remove surface defects which occur at the time of forming the anodizing film on the aluminum alloys for casting.

Third, it is possible to improve corrosion resistance, wear resistance, and film hardness of the anodized aluminum alloys for casting.

Although the present inventive concept has been shown and described with respect to specific exemplary embodiments, it will be obvious to those skilled in the art that the present disclosure may be variously modified and altered without departing from the spirit and scope of the present invention as defined by the following claims.

What is claimed is:

1. A method for surface treatment of aluminum alloys for casting, comprising:

forming an oxidation film in the aluminum alloys for casting by adding a metallic anion compound to an electrolytic solution, wherein the electrolytic solution is prepared using any one material selected from sulfuric acid and oxalic acid as a base, and wherein the metallic anion compound is $NaAlO_2$.

2. The method of claim 1, wherein the aluminum alloys for casting includes Si ranging from 4.0 to 24.0 wt %, and the oxidation film has a thickness which is set to be equal to or more than 5 μm.

3. The method of claim 2, comprising steps of:

coupling anions of the metallic anion compound included in the electrolytic solution with cracks formed on a surface of the aluminum alloys for casting by controlling a range of voltage, current, time, and temperature.

4. The method of claim 3, wherein the voltage is controlled to be within a range of 10 to 200 V, the current is controlled to be within a range of 0.2 to 10 $A/cm^2$, and the time is controlled to be within a range of 1 to 24 h, and the metallic anion compound is added within a range of 0.02 to 0.4 M.

* * * * *